US005829328A

United States Patent [19]

Chen

[11] Patent Number: 5,829,328

[45] Date of Patent: Nov. 3, 1998

[54] MULTIPLE SOCKETS WRENCH

[76] Inventor: Shyong-Chwan Chen, No. 1-5, Kwongshin Road, Taiping Hsiang, Taichung Hsien, Taiwan

[21] Appl. No.: 864,817

[22] Filed: May 29, 1997

Related U.S. Application Data

[63] Continuation of Ser. No. 510,502, Aug. 2, 1995, abandoned.

[51] Int. Cl.[6] ..... B25B 13/06

[52] U.S. Cl. ..... 81/185; 81/124.5; 81/DIG. 11

[58] Field of Search ..... 81/185, 124.4, 81/124.5, DIG. 11

[56] References Cited

U.S. PATENT DOCUMENTS

| | | | |
|---|---|---|---|
| 1,471,451 | 10/1923 | Crimp | 81/124.5 X |
| 1,896,949 | 2/1933 | Greiner | 81/185 |
| 1,997,948 | 4/1935 | Pearson | 81/185 |
| 3,127,797 | 4/1964 | Rogers | 81/185 X |
| 3,298,261 | 1/1967 | Lynn | 81/185 |
| 4,528,875 | 7/1985 | Hurst et al. | 81/185 |
| 5,163,344 | 11/1992 | Mathers | 81/124.5 |
| 5,460,064 | 10/1995 | Zayat, Jr. | 81/DIG. 11 X |

*Primary Examiner*—D. S. Meislin
*Attorney, Agent, or Firm*—Rosenberg, Klein & Bilker

[57] ABSTRACT

A multiple sockets wrench which is able to accommodate and twist a great variety of differently sized and shaped nuts, bolts and screws. The wrench includes a polygonal tubular housing and several groups of clamping blocks axially retractably received in a front end of the housing. When used to twist a nut or a bolt head, the nut or bolt head contacts with the groups of the clamping blocks to force the unsuitable contacted clamping blocks into the housing, while permit the suitable uncontacted clamping blocks to hold the nut or bolt head.

5 Claims, 8 Drawing Sheets

MULTIPLE SOCKETS WRENCH

This application is a continuation of application Ser. No. 08/510,502 filed on Aug. 2, 1995, now abandoned.

BACKGROUND OF THE INVENTION

The present invention relates to a multiple sockets wrench which is able to accommodate and twist a great variety of differently sized and shaped nuts, bolts and screws.

A conventional wrench or socket wrench has a wrench opening or a socket with single dimension and is adapted to a specifically sized nut or bolt. In order to twist various sizes of nuts or bolts, a variety of differently sized wrenches or socket wrenches must be prepared. This is ineconomic and it is difficult to carry numerous wrenches. Moreover, when working on a nut or bolt, it is necessary to exchangedly compare the wrenches with the nut or bolt one by one until a suitable wrench is found and selected. When a plurality of nuts or bolts needs to be tightened or loosened, such procedure must be repeatedly performed. This is quite inconvenient and time-costing and will inevitably reduce the working efficiency. In addition, some wrenches may be lost during frequent exchange. Although a universal wrench with adjustable opening is nowadays available, the span of such wrench can be only adjusted at a very slow speed and the movable opening of such wrench is apt to loosen during work to cause abrasion or damage of the nut or bolt. This will result in that the nut or bolt cannot be completely tightened or untightened.

SUMMARY OF THE INVENTION

It is therefore a primary object of the present invention to provide a multiple sockets wrench which is able to accommodate and twist a great variety of differently sized and shaped nuts, bolts and screws. The present wrench includes a polygonal tubular housing and several groups of clamping blocks axially retractably received in a front end of the housing. When used to twist a nut or a bolt head, the nut or bolt head contacts with the groups of the clamping blocks to force the unsuitable contacted clamping blocks into the housing, while permit the suitable uncontacted clamping blocks to hold the nut or bolt head. Accordingly, the present multiple sockets wrench in single unit form can accommodate a wide variety of nuts or bolts instead of numerous wrenches with different sizes. This economically eliminates the needs of repeated comparison, selection and exchange of the wrenches or socket wrenches as in the conventional tools. Moreover, the present multiple sockets wrench can be easily carried and used to expedite the working efficiency.

The present invention can be best understood through the following description and accompanying drawing, wherein:

DETAILED DESCRIPTION OF THE PREFERRED EMBODIMENTS

Figure 1:
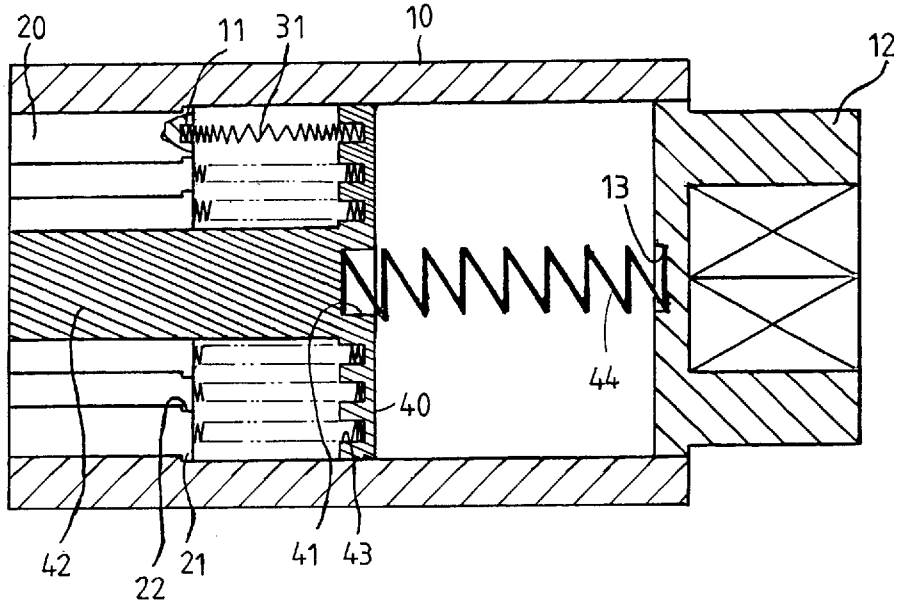
FIG. 1 is a sectional assembled view of a first embodiment of the present invention.
Figure 1A:
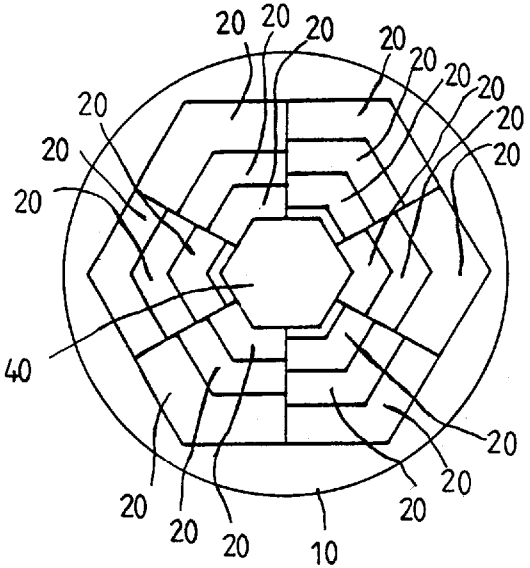
FIG. 1A is a front view according to FIG. 1.
Figure 2:
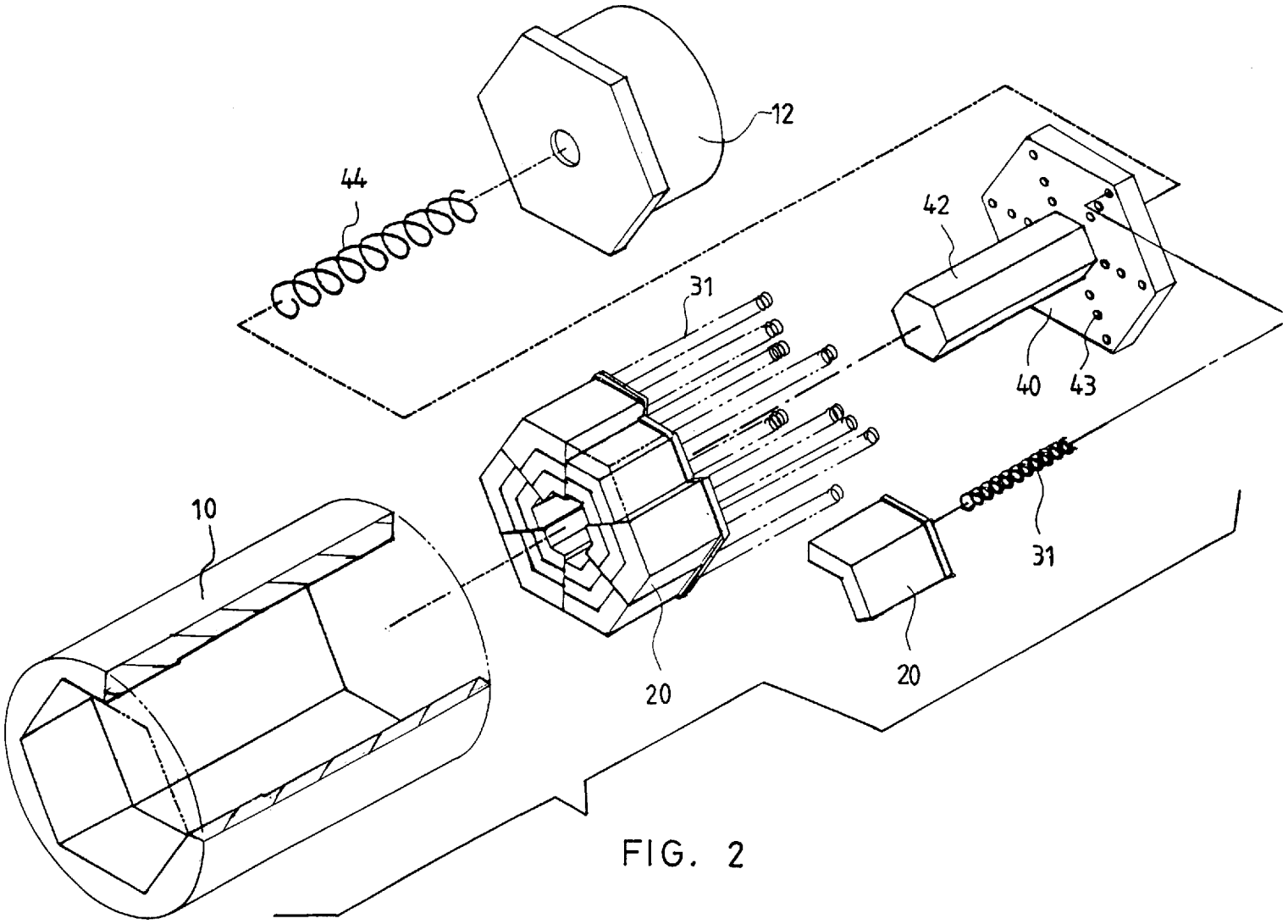
FIG. 2 is a perspective exploded view according to FIG. 1.
Figure 3:
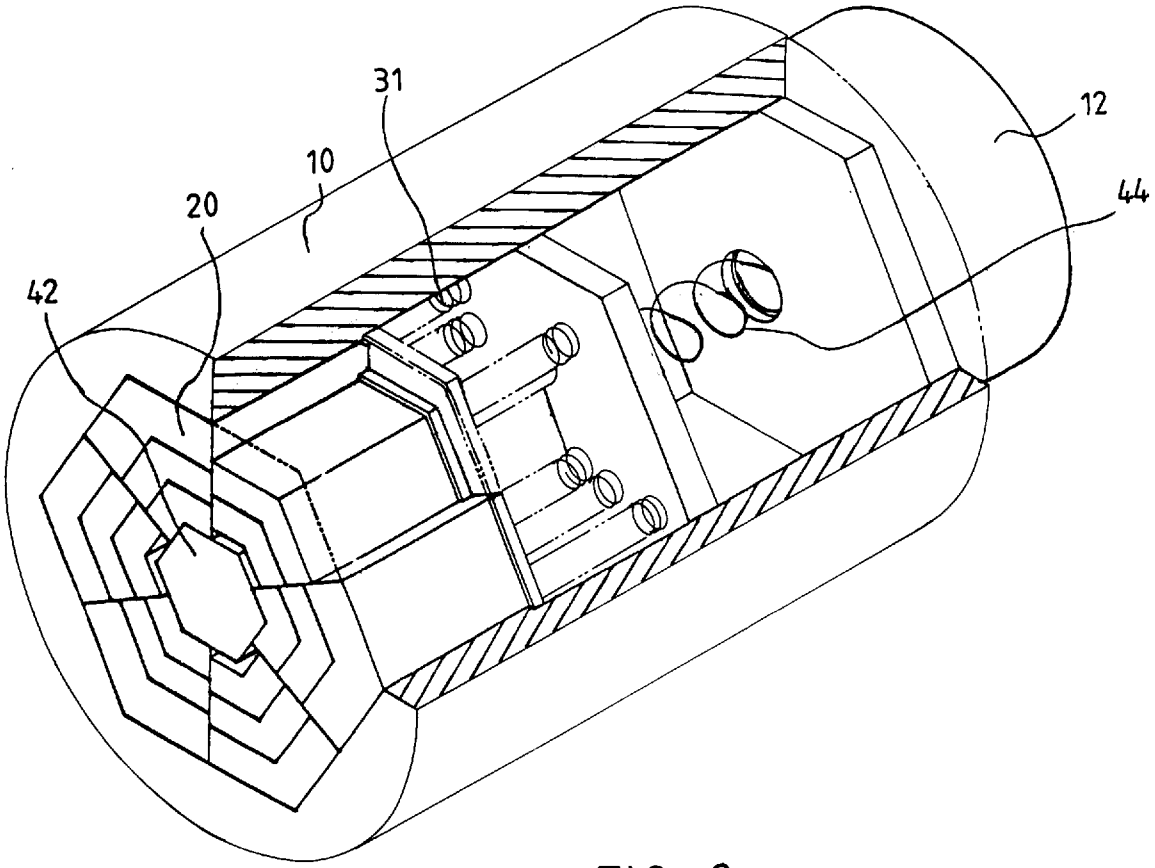
FIG. 3 is a perspective partially sectional view according to FIG. 2.

Please refer to FIGS. 1 to 3. The present invention includes:

a polygonal tubular housing 10 having a drive section 12 at a rear end and an annular recess 11 on inner wall near a front end, a first recessed seat 13 being formed on a front face of the drive section 12, the drive section 12 being adapted to accommodate a drive lever;

multiple clamping blocks 20 received in the front end of the housing 10 and divided into several groups consisting of several adjacent stacked clamping blocks 20, each clamping block 20 being formed with a projection 21 and a depression 22 on two lateral edges of a rear end, a first locating spring 31 being engaged with and extending from the rear end face of each clamping block 20, the projections 21 and depressions 22 of the clamping blocks 20 being engaged with one another by insertion with the projections 21 of the outermost clamping blocks engaged with the annular recess 11 of the housing 10; and a spring seat 40 disposed in the housing 10 beside the clamping blocks 20, the spring seat 40 being a polygonal flat board formed with multiple cavities 43 in which the springs 31 are seated, the spring seat 40 having a polygonal locating bar 42 forward extending from a front face of the spring seat 40 and surrounded by the groups of clamping blocks 20 for locating the same, a second recessed seat 41 being formed on a rear face of the spring seat 40, whereby a second locating spring 44 is disposed between the first recessed seat 13 of the drive section 12 and the second recessed seat 41 of the spring seat 40.

Figure 4:
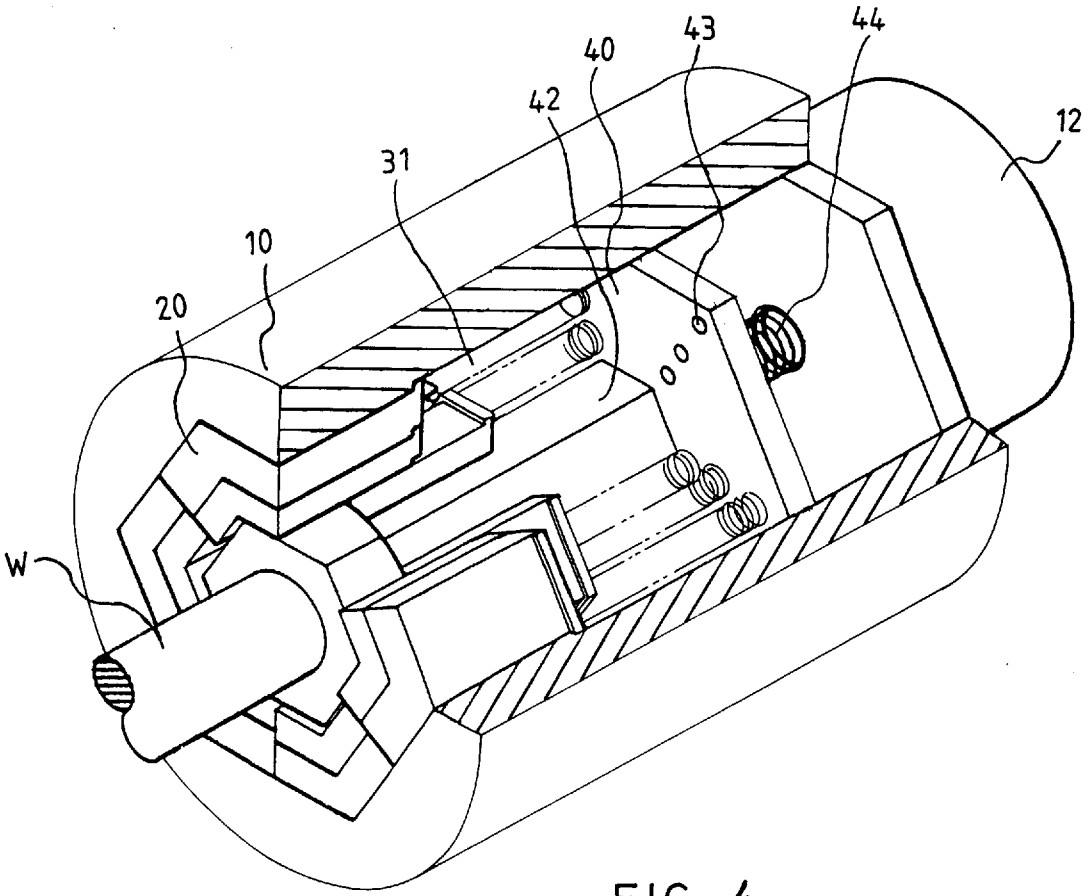
FIG. 4 is a view according to FIG. 3, showing the operation of the first embodiment of the present invention.
Figure 5:
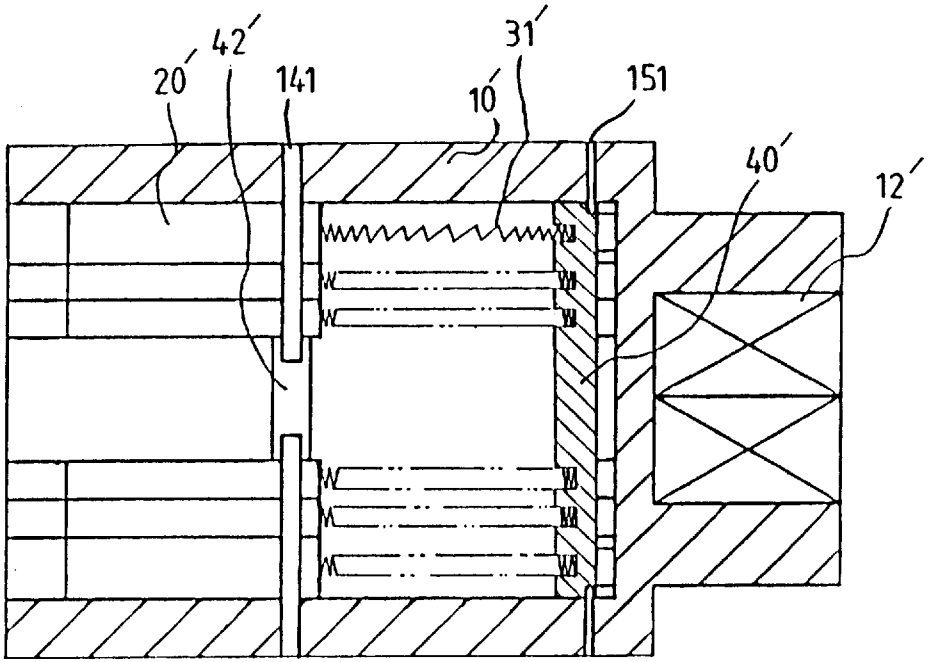
FIG. 5 is a sectional view showing a second embodiment of the present invention.
Figure 5A:
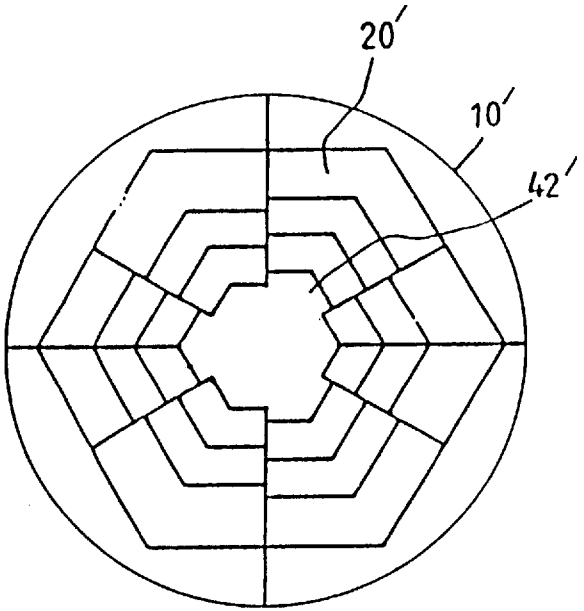
FIG. 5A is a front view according to FIG. 5.
Figure 6:
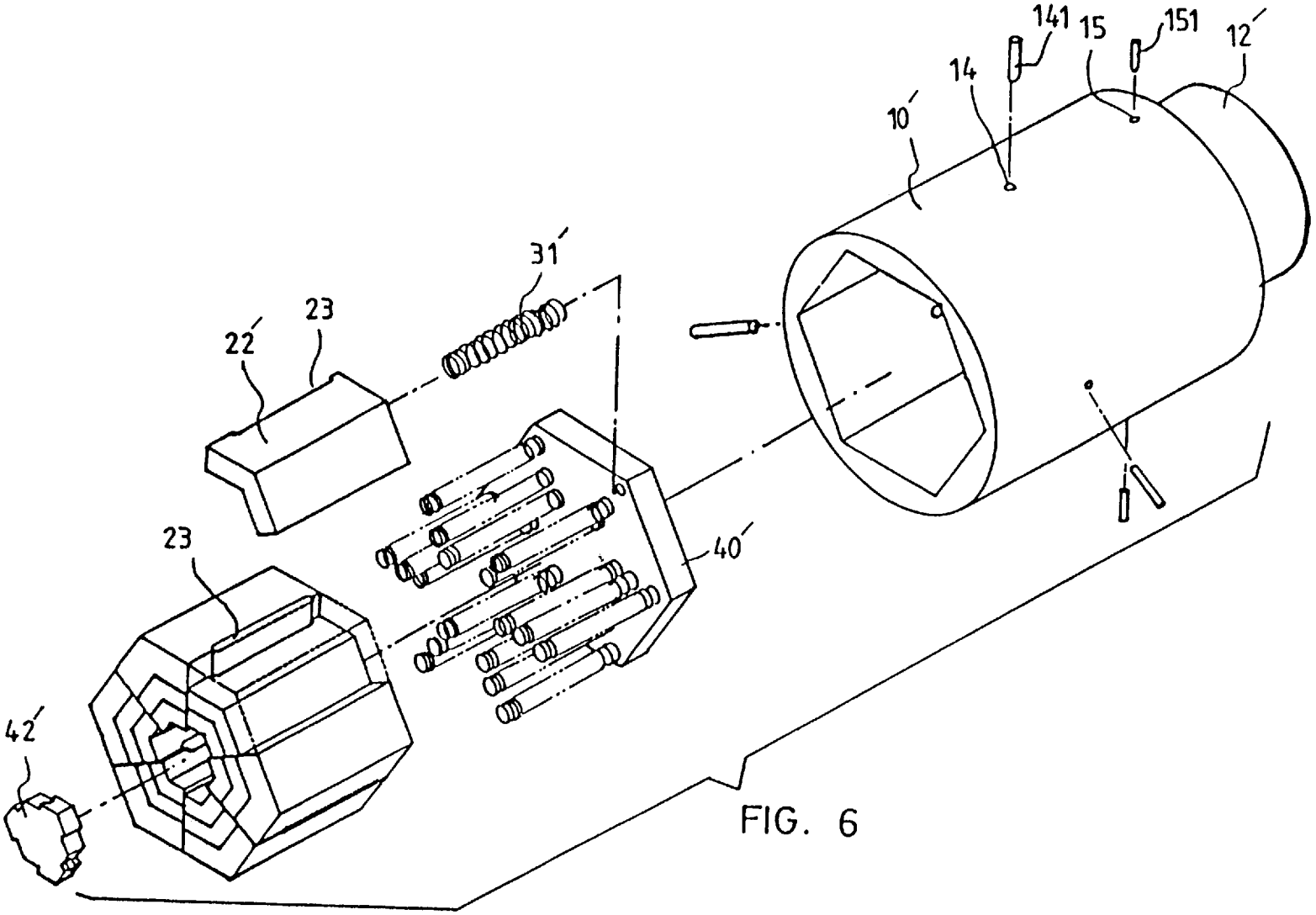
FIG. 6. is a perspective exploded view according to FIG. 5.
Figure 7:
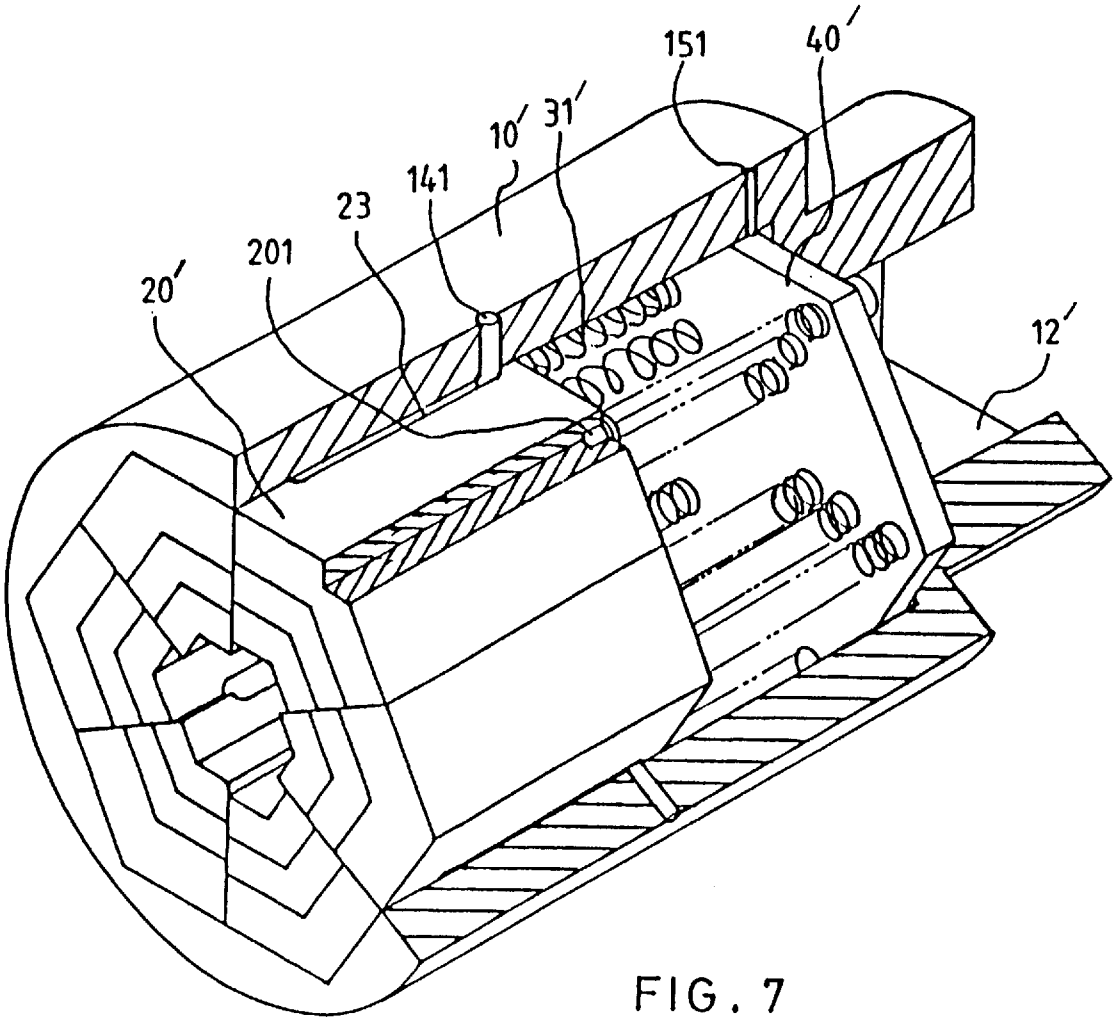
FIG. 7 is a perspective partially sectional view according to FIG. 5.
Figure 8:
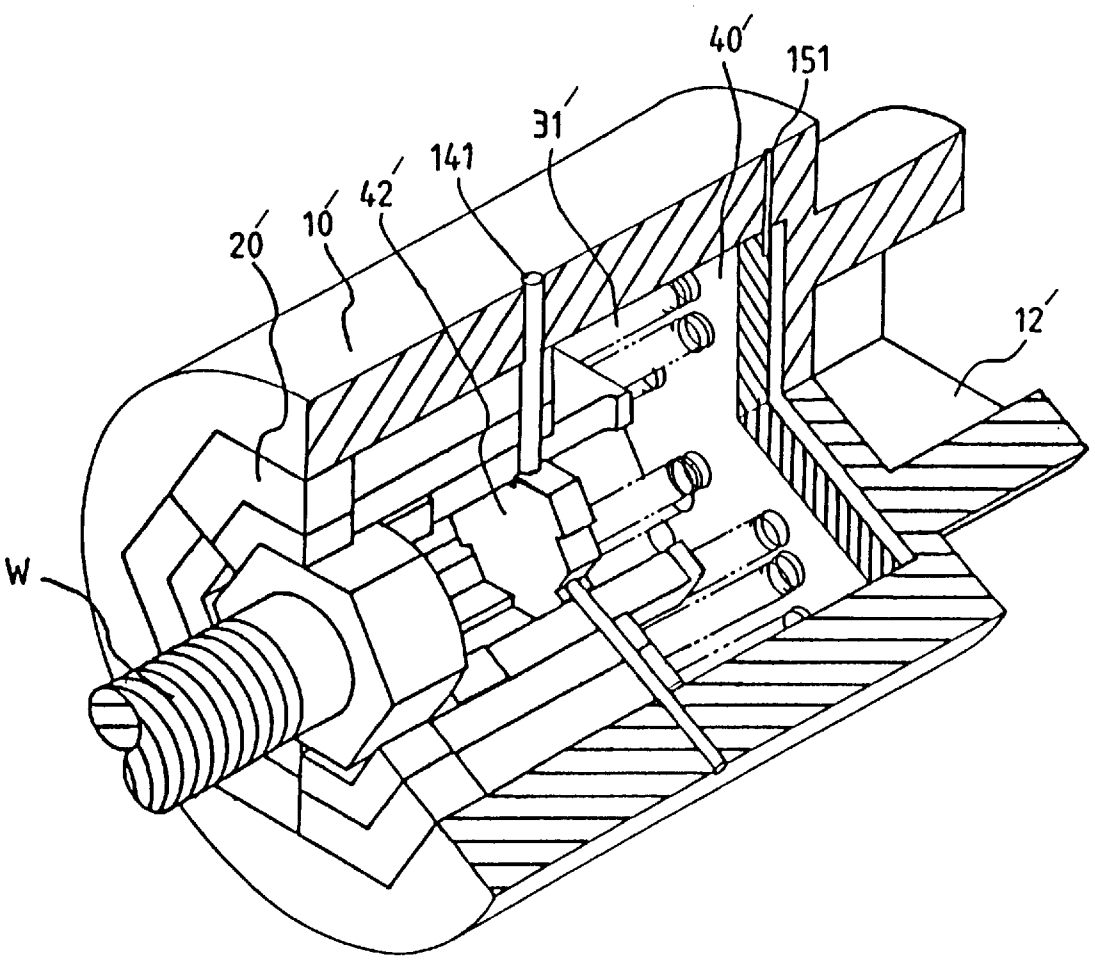
FIG. 8 is a perspective view according to FIG. 7, showing the operation of the second embodiment of the present invention.

According to the above arrangements, as shown in FIG. 4, when used to twist a nut or a bolt head W, the nut or bolt head W contacts with the groups of clamping blocks 22 to force the locating bar 42 and the unsuitable contacted clamping blocks 22 into the housing 10 and leave the uncontacted clamping blocks 22 which are suitable for holding the nut or bolt head W in their rest positions. At this time, the drive lever fitted in the drive section 12 of the housing 10 can be rotated to tighten or loosen the nut of bolt head W.

Please refer to FIGS. 5 to 8. In an alternative embodiment of the present invention, several fixing pin holes 15 are provided on the lateral walls of the housing 10' near the drive section 12' for receiving several fixing pins 151, while several locating pin holes 14 are provided on the lateral walls of the housing 10' near the front end thereof for receiving several locating pins 141. The fixing pins 151 serve to secure the spring seat 40 on the front face of the drive section 12'.

Each clamping block 20' is formed with a dent 23 on a lateral side thereof and the dents 23 of each two adjacent clamping blocks 20' are combined to define a slide slot, whereby the locating pins 141 can inward pass through the locating pin holes 14 of the housing 10' into the respective slide slots so as to permit a predetermined restricted axial travel of the clamping blocks. Each clamping block 20' is further formed with a passage 201 into which the spring 31' extends. This embodiment is able to achieve the same effect as the preceding embodiment.

In practical use, the present invention has several advantages over the conventional devices as follow:

1. The single wrench of the present invention is able to accommodate and twist a great variety of differently sized and shaped nuts, bolts and screws. The present wrench has relatively small volume and can be readily carried, operated and stored.

The operation of the present wrench can be quickly performed without using any other special tools or measure.

3. The present wrench has simple structure and can be easily manufactured and assembled, while having very good working efficiency.

It is to be understood that the above description and drawings are only used for illustrating some preferred embodiments of the present invention, not intended to limit the scope thereof. Any variation and derivation from the above description and drawings should be included in the scope of the present invention.

What is claimed is:

1. A multiple socket wrench comprising:

a tubular housing with front and rear ends having a polygonal opening therein, and a driving section at the rear end thereof, a plurality of clamping blocks received in said front end of said housing and divided into a plurality of groups, each group comprising a plurality of adjacent stacked clamping blocks, and locating means for locating the clamping blocks in the housing;

a spring seat disposed in said housing, said spring seat comprising a polygonal flat board formed with multiple cavities; fixing means for locating said spring seat in said housing; and a plurality of first locating springs, a first locating spring extending between a cavity of the spring seat and each of the plurality of clamping blocks; and a polygonal locating bar extending forwardly from a front face of said spring seat and surrounded by the groups of clamping blocks for locating the groups of clamping blocks.

2. The multiple socket wrench as claimed in claim 1, wherein the fixing means comprises fixing pin holes provided on lateral walls of said housing adjacent said drive section; a fixing pin located in each fixing pin hole and extending into the housing in contact with said spring seat to locate said spring seat; and wherein said locating means comprises a plurality of locating pin holes provided on lateral walls of the housing adjacent said front end thereof; a locating pin located in each locating pin hole and extending into the housing; a dent formed in a lateral side of each clamping block such that the dents of each two adjacent clamping blocks form an elongated slide slot, whereby said locating pins pass through said locating pin holes of said housing into said elongated slide slots so as to permit a predetermined axial travel of said clamping blocks relating to said housing.

3. The multiple socket wrench as claimed in claim 1 wherein the locating means comprises:

a) a projection and a depression formed on opposite rear edges of each clamping block said projections of one clamping block engaging a depression of an adjacent clamping block; and, b) an annular recess on an inner wall of the housing located such that the projections of the clamping blocks adjacent to the housing engage the annular recess.

4. A multiple socket wrench comprising:

a tubular housing with front and rear ends having a polygonal opening therein, and a driving section at the rear end thereof, a plurality of clamping blocks received in said front end of said housing and divided into a plurality of groups, each group comprising a plurality of adjacent stacked clamping blocks, and locating means for locating the clamping blocks in the housing;

a spring seat disposed in said housing, said spring seat comprising a polygonal flat board formed with multiple cavities; fixing means for locating said spring seat in said housing; and a plurality of first locating springs, a first locating spring extending between a cavity of the spring seat and each of the plurality of clamping blocks;

said fixing means including:

a) a first recessed seat formed on said housing;

b) a second recessed seat formed on said spring seat; and, d) a second locating spring extending between said first and said second recessed seats.

5. The multiple socket wrench as claimed in claim 4 further comprising a polygonal locating bar extending forwardly from a front face of said spring seat and surrounded by the groups of clamping blocks for locating the groups of clamping blocks.

* * * * *